US007059749B1

(12) United States Patent
Bernier

(10) Patent No.: US 7,059,749 B1
(45) Date of Patent: Jun. 13, 2006

(54) CLIPPING APPARATUS FOR ATTACHING CORDS TO WALLS

(76) Inventor: Joseph Bernier, 8962 W. Tonopah Dr., Peoria, AZ (US) 85382

( * ) Notice: Subject to any disclaimer, the term of this patent is extended or adjusted under 35 U.S.C. 154(b) by 0 days.

(21) Appl. No.: 11/039,406

(22) Filed: Jan. 19, 2005

(51) Int. Cl.
*F21V 21/088* (2006.01)

(52) U.S. Cl. ..... 362/396; 362/250; 24/336; 248/229.26

(58) Field of Classification Search ..... 362/249, 362/250, 396; 24/336; 248/229.16, 229.2, 248/229.22, 229.26
See application file for complete search history.

(56) References Cited

U.S. PATENT DOCUMENTS 3,883,926 A 5/1975 Reynolds ..... 24/73
5,141,192 A 8/1992 Adams ..... 248/231.8
6,305,822 B1 10/2001 Lin ..... 362/249
6,536,727 B1 * 3/2003 Limber et al. ..... 248/229.26
6,663,069 B1 * 12/2003 Norberg ..... 248/229.26

* cited by examiner

*Primary Examiner*—Stephen F Husar
(74) *Attorney, Agent, or Firm*—Goldstein Law Offices PC.

(57) ABSTRACT

A clipping apparatus for preventing tripping hazards caused by cords and simplifying installation of decorative lights having a tension clip. The tension clip is substantially U-shaped having an elongated member having two downwardly extending arms, each arm having a base. Each base has a small, V-shaped recessed channel through which a cord or strand of lights extends. A fully adjustable slide and click mechanism lengthens or shortens the elongated member of the tension clip. A pair of outwardly angled and extending fasteners define a simple clip mechanism attached to the elongated member and or one or both of the two arms for use in suspending the cord from tension clips installed upside down.

5 Claims, 2 Drawing Sheets

CLIPPING APPARATUS FOR ATTACHING CORDS TO WALLS

BACKGROUND OF THE INVENTION

The invention relates to clipping devices, and more particularly, to a clipping apparatus used to attach cords to common permanent objects like walls, rafters, decks, fences, banisters, eaves, soffits, and awnings, for preventing tripping hazards caused by cords and simplifying installation of decorative lights.

The winter holiday season is a magical time of year. Celebrating Hanukkah, Kwanza or Christmas, can renew one's faith and revive the spirit of giving that is often lacking throughout the year. In particular, Christians celebrate Christmas in the United States and across the globe. Spending time with friends and family, shopping for gifts and sending colorful greeting cards, are wonderful activities that most who celebrate Christmas enjoy. One of the many prevalent ways people share their enthusiasm with others is by decorating their homes for the holiday season. A wonderful way to decorate for the holidays is by hanging strands of brilliantly lit lights outside of the home. Providing a sense of warmth and comfort, strung lights welcome guests and holiday revelers in a friendly and joyous fashion. Although typically associated with Christmas, string lights are increasingly being embraced as an affordable and attractive means of decorating throughout the year. Manufactured in a multitude of colored sets, many enjoy hanging colored, themed lights from season to season. Shimmery and beautiful, a strain of lights can add the perfect finishing touch to any décor.

U.S. Pat. No. 3,883,926 to Reynolds discloses a hanger clamp having a U-shaped base for attachment to a rafter for holding an electrical bulb. U.S. Pat. No. 6,305,822 to Lin discloses a holding frame supported with U-shaped clips for securing a string of Christmas light bulbs. U.S. Pat. No. 5,141,192 to Adams discloses a spiral and curved hook for attachment to the gutter of a building to hold a wire of Christmas tree lights.

While these units may be suitable for the particular purpose employed, or for general use, they would not be as suitable for the purposes of the present invention as disclosed hereafter.

SUMMARY OF THE INVENTION

It is an object of the invention to produce a means for preventing tripping hazards caused by cords and simplifying installation of decorative lights. Accordingly, the invention is a clipping apparatus for attaching cords to the wall or the like.

It is another object of the invention to provide a means for hanging decorative lights around outside and inside of homes and yards without damage to existing surfaces. Accordingly, the clipping apparatus has a tension clip, configured specifically to easily secure cords or strands of decorative or holiday lights to existing outdoor rain spouts, walls, fences and similar structures without damage to existing surfaces.

It is another object of the invention to provide a safer home and work environment, without hazards caused by electric shock. Accordingly, the tension clip of the invention has an elongated member and two arms, each arm having a recessed channel for safely holding cords therein for providing a safe home and work environment.

It is another object of the invention to assist medical professionals in safely securing intravenous cords, and the like, out of the way of the patient. Accordingly, the tension clip of the invention can be utilized to hold intravenous cords securely through the recessed channels within the arms for assisting medical professionals.

This invention is a clipping apparatus for preventing tripping hazards caused by cords and simplifying installation of decorative lights having a tension clip. The tension clip is substantially U-shaped having an elongated member having two downwardly extending arms, each arm having a base. Each base has a small, V-shaped recessed channel through which a cord or strand of lights extends. A fully adjustable slide and click mechanism lengthens or shortens the elongated member of the tension clip. A pair of outwardly angled and extending fasteners define a simple clip mechanism attached to the elongated member and or one or both of the two arms for use in suspending the cord from tension clips installed upside down.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
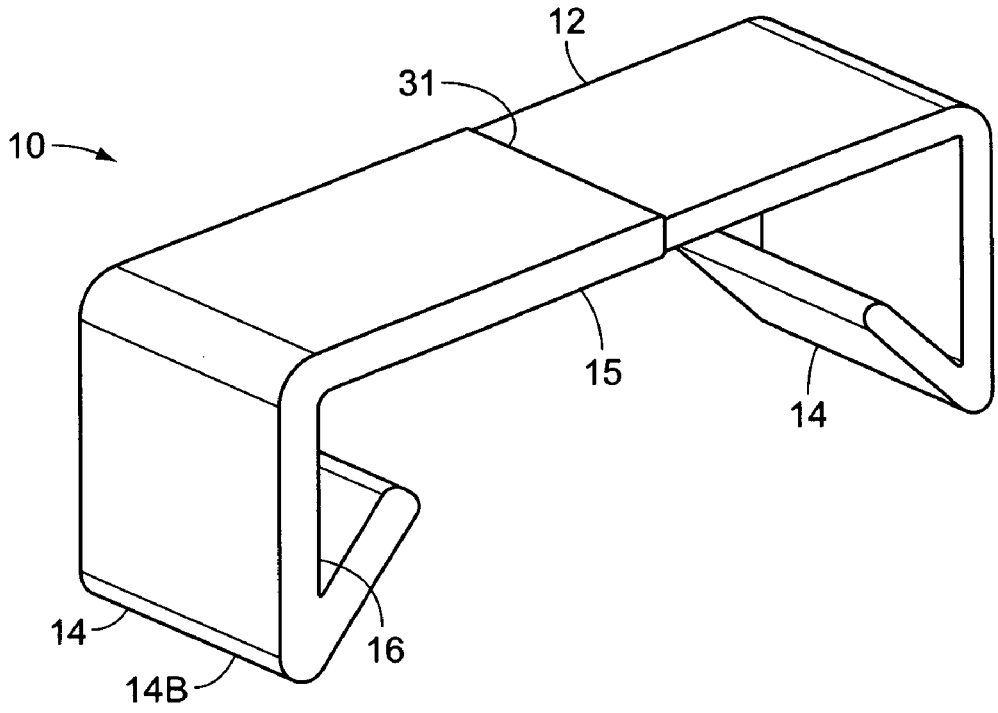
FIG. 1 is a diagrammatic perspective view of the clipping apparatus of the present invention having a tension clip substantially U-shaped having an elongated member and two arms, each arm having a recessed channel.

FIG. 1 illustrates a clipping apparatus 10 of the present invention for preventing tripping hazards caused by cords and simplifying installation of decorative lights.

The clipping apparatus 10 has a tension clip 12, configured specifically to easily secure strands of decorative or holiday lights to existing outdoor rain spouts, walls, fences and similar structures without damages to existing surfaces. Preferably, the tension clip 12 is made of durable, plastic material. The tension clip 12 is substantially U-shaped having an elongated member 15 having two downwardly extending arms 14. Each arm 14 has a base 14B. Each base 14B of the arm 14 of the tension clip 12 has a small, V-shaped recessed channel 16 through which the user runs light strands thus securely hooking and holding both the tension clip 12 and attached light strand in position. The tension clip 12 decorates exterior of homes with dazzling outdoor lights for holidays.

The tension clip 12 is designed to be clamped or hooked to a designated object like walls, rafters, decks, fences, banisters, eaves, soffits, and awnings, preferably perpendicularly. The tension clip preferably measures approximately three-quarters inches to one inch in width and one and one half to two inches in height. The elongated member 15 of the tension clip 15 varies in size for use with various tasks. In particular embodiments, one inch and two inch tension clips 12 may be used with wrought iron fences, banisters and railings, three inch tension clips 12 for use with gates and wooden fences, and six inch tension clips 12 for use with rain spouts.

In one embodiment, the elongated member 15 may include a fully adjustable slide and click mechanism 31 for lengthening or shortening the elongated member 15 of the tension clip 12 to enable the user to lengthen or shorten the tension clip 12 as desired to accommodate their task.

Figure 3:
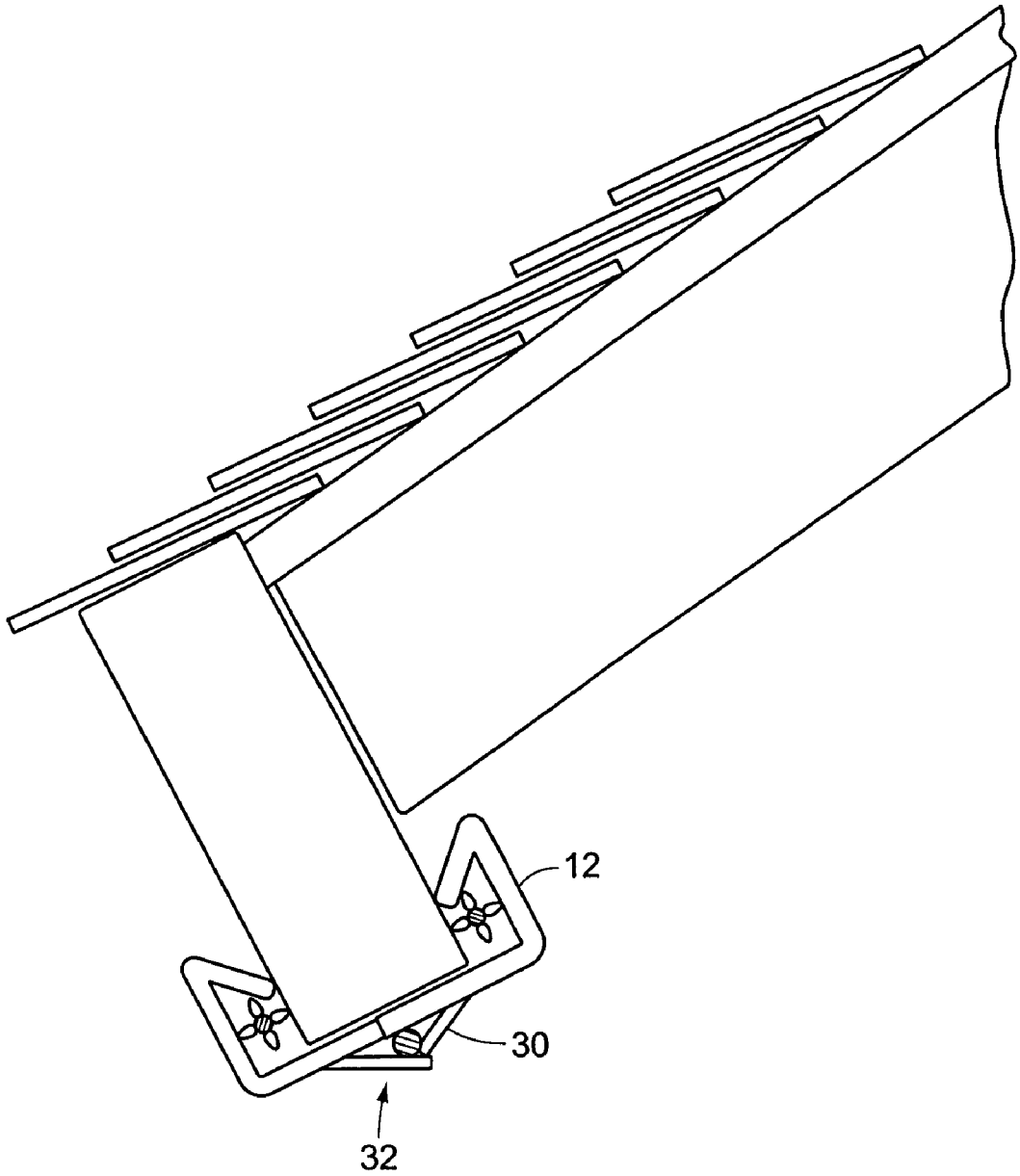
FIG. 3 is a diagrammatic perspective view of the clipping apparatus of the present invention wherein the elongated member or arms may also include two outwardly angled and extending fasteners which define a simple clip mechanism.

In additional, the elongated member 15, and or the two arms 14 may also include two outwardly angled and extending fasteners 30, shown in FIG. 3, which define a simple clip mechanism 32 for use in suspending lights from tension clips 12 installed upside down.

The tension clip 12 allows users to hang lights without ever puncturing light strands and exposing electrical wiring, thereby greatly reducing fire hazards associated with operating outdoor lighting during inclement weather. The tension clip 12 allows users to hang their decorative holiday lights in a fraction of the time required by other methods. A one step application, users appreciate the ease at which the tension clip 12 can be installed. A practical household accessory, the tension clip 12, enables users to secure a variety of cords, neatly and efficiently, including securing long cords of lamps, stereos, computers and similar electronic equipment, as well as cable lines, extension cords and phone cords to furniture or molding, the tension clip 12 protects consumers from many hazards associated with tangled and exposed cords. The tension clip 12 proves especially useful for millions of parents and caregivers of small children. Securely keeping dangerous electrical cords from curious and inquisitive little eyes and hands, the tension clip 12 proves and invaluable safety device in any home. The tension clip 12 prevents puppies and kittens from chewing on electrical cords, protecting precious pet from danger and harm. Additionally, because electrical cords are anchored, painful falls and accidental missteps that result from trips over excess and slipping floor cords would be eliminated. Ideal for households, the tension clip 12 can be utilized by construction workers, electricians and other professional contractors as a safe and secure means of securing loose electrical cords and cables when working. Furthermore, in a medical profession the tension clip 12 is utilized for safely tethering intravenous lines, feeding tubes, and cords of various medical equipment and devices, preventing these lines, feeding tubes, and cords of various medical equipment and devices, preventing these lines and cords from becoming tangled or accidentally pulling loose during use. Easily applied, the tension clip 12 can be adhered quickly and with little effort. Lightweight, yet gentle, the tension clip 12 is safe for use on a variety of surfaces, regardless of whether heavy duty siding or delicate furnishings. Durable construction of quality materials, these unique tension clips 12 should withstand years of repeated use.

Figure 2:
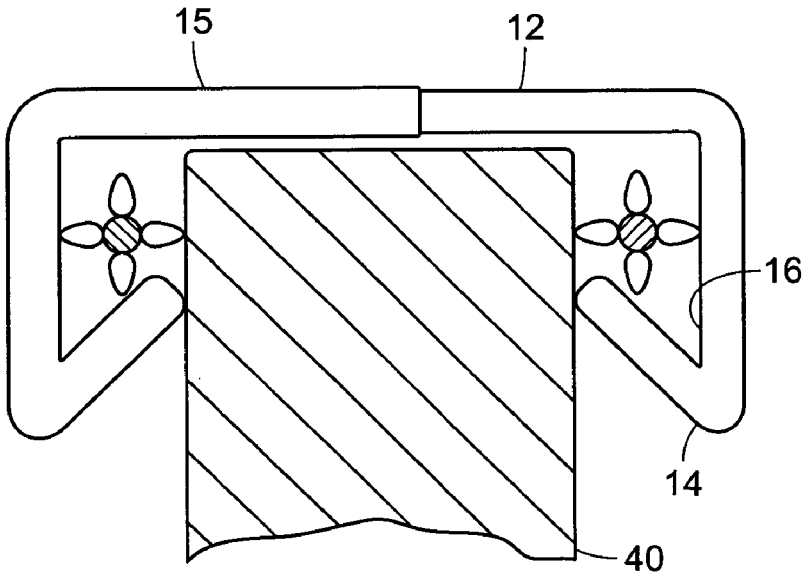
FIG. 2 is a diagrammatic perspective view of the clipping apparatus of the present invention in use holding cords for preventing tripping hazards and simplifying installation of decorative lights.

FIG. 2 illustrates the clipping apparatus of the present invention in use hanging a cord from a designated surface, in this case a strand of lights from a fence 40. To install, the user simply strings outdoor lights onto designated surfaces such as a railing, fence or rain spout, securing a strand at approximately five to ten inch intervals. First, the user grasps the tension clip 12 in one hand, holding a section of strand of lights against the fence with the other hand. Next, the user hooks the tension clip 12 into position, allowing the strand of lights to pass through one of the recessed channels 16 integrated into one arm 14 of the tension clip 12, making sure the elongated member 15 of the tension clip 12 lies flat against the fence, while the arms 14 of the tension clip 12 snugly grasp either side of the fence 40. Once the entire strand of lights has been installed upon the fence 40, the user simply plugs the lights into an electrical socket and enjoys the dazzling look. At the end of the holiday season, the strand of lights is easily removed from the fence 40 by reversing the installation process.

In conclusion, herein is presented a clipping apparatus for preventing tripping hazards caused by cords and simplifying installation of decorative lights. The invention is illustrated by example in the drawing figures, and throughout the written description. It should be understood that numerous variations are possible, while adhering to the inventive concept. Such variations are contemplated as being a part of the present invention.

What is claimed is:

1. A clipping apparatus for preventing tripping hazards caused by cords and simplifying installation of decorative lights, comprising:

a tension clip substantially U-shaped having an elongated member having two downwardly extending arms, each arm having a base, each base having a small, V-shaped recessed channel through which a strand of lights extends;

a fully adjustable slide and click mechanism for lengthening or shortening the elongated member of the tension clip to enable the user to lengthen or shorten the tension clip; and a pair of outwardly angled and extending fasteners defining a simple clip mechanism attached to the elongated member and or one or both of the two arms for use in suspending the strand of lights from tension clips installed upside down.

2. A clipping apparatus for preventing tripping hazards caused by cords and simplifying installation of decorative lights, comprising:

a tension clip substantially U-shaped having an elongated member having two downwardly extending arms, each arm having a base, each base having a small, V-shaped recessed channel through which a strand of lights extends.

3. The clipping apparatus of claim 2, further comprising a fully adjustable slide and click mechanism for lengthening or shortening the elongated member of the tension clip to enable the user to lengthen or shorten the tension clip.

4. The clipping apparatus of claim 3, further comprising a pair of outwardly angled and extending fasteners defining a simple clip mechanism attached to the elongated member and or one or both of the two arms for use in suspending the strand of lights from tension clips installed upside down.

5. A method of securing cords on a designated surface, using a clipping apparatus, having a tension clip, the tension clip having an elongated member and two arms, each arm having a recessed channel, the steps comprising:

stringing the cord onto the designated surface at approximately five to ten inch intervals by grasping the tension clip in one hand, and holding a section of cord against the designated surface with the other hand and hooking the tension clip onto the designated surface; and passing the cords through one of the recessed channels integrated into one arm of the tension clip, making sure the elongated member of the tension clip lies flat against the designated surface, while the arms of the tension clip snugly grasp either side of the designated surface.

* * * * *